United States Patent [19]

Scarfe et al.

[11] 4,117,687

[45] Oct. 3, 1978

[54] MINE ROOF SUPPORTS

[75] Inventors: Arthur Scarfe; John Cambridge Smith, both of Wakefield, England

[73] Assignee: Fletcher Sutcliffe Wild Limited, Wakefield, England

[21] Appl. No.: 862,385

[22] Filed: Dec. 20, 1977

[30] Foreign Application Priority Data

Dec. 29, 1976 [GB] United Kingdom ..... 54266/76

[51] Int. Cl.[2] ..... E21D 15/44

[52] U.S. Cl. ..... 405/292

[58] Field of Search ..... 61/45 D; 299/31-33; 248/357; 91/170 MP

[56] References Cited

U.S. PATENT DOCUMENTS

| | | | |
|---|---|---|---|
| 3,309,054 | 3/1967 | Davis-Ratcliffe | 61/45 D X |
| 3,530,490 | 9/1970 | Ward et al. | 91/170 MP |
| 3,832,856 | 9/1974 | Sigott et al. | 61/45 D |
| 4,030,308 | 6/1977 | Dudley et al. | 248/357 |

FOREIGN PATENT DOCUMENTS

| | | | |
|---|---|---|---|
| 1,295,075 | 11/1972 | United Kingdom | 61/45 D |

*Primary Examiner*—Dennis L. Taylor

*Attorney, Agent, or Firm*—Lowe, King, Price & Becker

[57] ABSTRACT

A mine roof support comprises at least one hydraulically extensible chock leg connected at its upper end in articulated manner to a roof beam of the support, and connected at its lower end in articulated manner to a base member of the support, a pair of links each having bearing surfaces adapted either to embrace a common chock leg by bearing on opposite sides thereof or to bear on adjacent sides of a pair of spaced apart chock legs, one end of each link being pivotally attached to the base member at a pivot point located to one side of a diametral plane passing through the longitudinal axis of the chock leg on which the link bears, the other end of the link being located to the other side of that plane and being acted upon by a restoring ram adapted to displace the or each link about it or their respective pivot points, to restore the or each leg to its predetermined position upon release of the support from the roof, and also to resist tendency for the or each leg to become displaced from the predetermined position while the support is engaged with the roof, and stop means also mounted on the base member and engageable by the or each other link end to determine the maximum displacement of the or each link by the ram.

10 Claims, 6 Drawing Figures

MINE ROOF SUPPORTS

Figure 1:
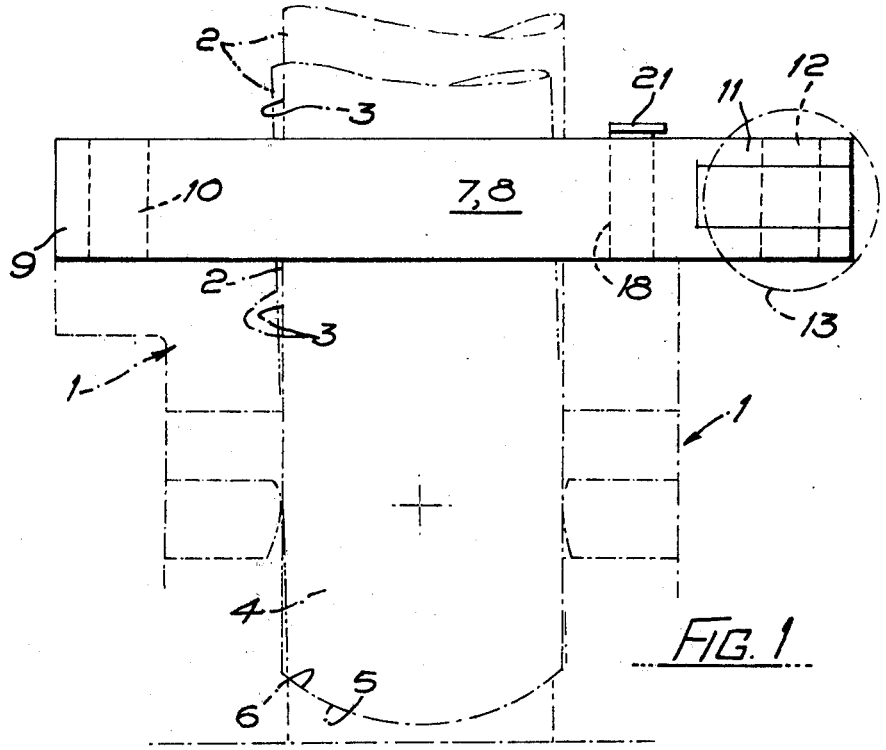

This invention relates to mine roof supports of the type incorporating a plurality of hydraulically extensible chock legs connected between at least one roof beam and at least one base member of the support.

Supports of the above type are commonly used in the longwall mining of minerals by being spaced along a mineral face, with an armored face conveyor interposed between the supports and the face. The supports are connected to individual sections of the conveyor, by one or more double-acting, hydraulic advancing rams, so that with the chock legs pressurised the advancing ram(s) may be extended to push a conveyor section towards the newly exposed mineral face, after passage of a mineral cutting machine, and conversely when it is required thereafter to advance the support to the conveyor, the chock legs are brought into retracted condition and the advancing ram(s) is retracted so that the support pulls itself forward from the conveyor.

In practice, however, firstly there is relative movement between the mine roof and the mine floor and secondly the roof beam(s) of the support may strike a projection from the roof, whilst advancing. Both of these situations have the effect that if the chock legs are assumed initially to be set vertically, their upper ends (and hence the roof beam(s) carried thereby) are displaced away from the mineral face by a few degrees. To avoid damage to roof supports by bending or distortion due to this displacement, several constructions have been proposed not only to provide accommodation for a few degrees displacement, e.g., up to 5° but also to restore the chock legs to a required predetermined position after being so displaced and after release from the roof. Thus the ends of the chock legs have been articulated to their base members and roof beams, for example by being formed as ball and socket joints, while a miscellany of means have been proposed for restoring the chock leg to a predetermined position. Such proposals have included for instance springs both of the coil and leaf type, small rams, inflatable formers under hydraulic or pneumatic control, and rubber blocks.

According to the present invention, a mine roof support comprises at least one hydraulically extensible chock leg connected at its upper end in articulated manner to a roof beam of the support, and connected at its lower end in articulated manner to a base member of the support, a pair of links each having bearing surfaces adapted either to embrace a common chock leg by bearing on opposite sides thereof or to bear on adjacent sides of a pair of spaced apart chock legs, one end of each link being pivotally attached to the base member at a pivot point located to one side of a diametral plane passing through the longitudinal axis of the chock leg on which the link bears, the other end of the link being located to the other side of that plane and being acted upon by a restoring ram adapted to displace the or each link about it or their respective pivot points, to restore the or each leg to its predetermined position upon release of the support from the roof, and also to resist tendency for the or each leg to become displaced from the predetermined position whilst the support is engaged with the roof, and stop means also mounted on the base member and engageable by the or each other link end to determine the maximum displacement of the or each link by the ram.

Thus, the ram may be permanently pressurised to urge the or each link towards and/or against the stop means so that any displacement of the or each chock leg must first overcome the force due to pressurization of the ram resisting such displacement.

Preferably, a common restoring ram is provided for a pair of links, although individual links may have individual restoring rams.

The links may have rectilinear, concave, or both rectilinear and concave bearing surfaces. Preferably, any concavity corresponds generally to the external periphery of the associated leg, while with wholly rectilinear bearing surfaces, the latter define a shallow "V."

For a single leg the stop means may be constituted by a common stop mounted on the base member and located adjacent the ram between the ends of the links connected thereto. This stop may also carry a retaining strap to ensure that the links are not lifted from the base member by movement of the leg.

For a pair of chock legs extending between a common roof beam and a common base member and the links disposed between the legs, a stop member is mounted adjacent each leg.

With either construction, the stop member may be adjustable in position and/or dimension, so as to accommodate required variations of the predetermined chock leg position.

Figure 2:
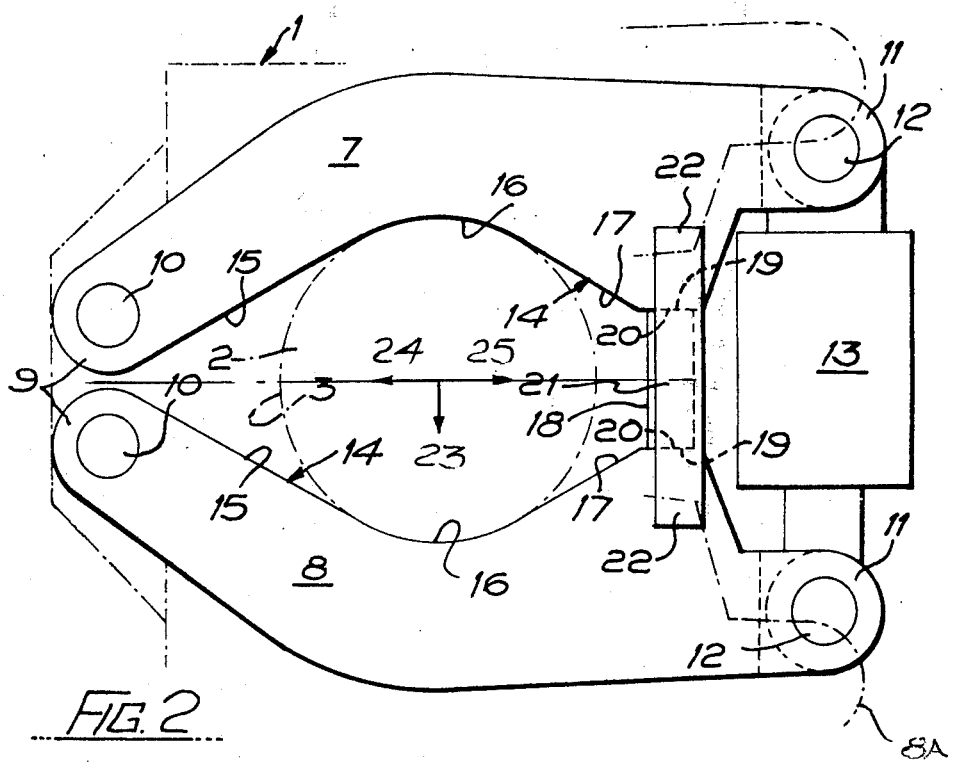
Figure 3:
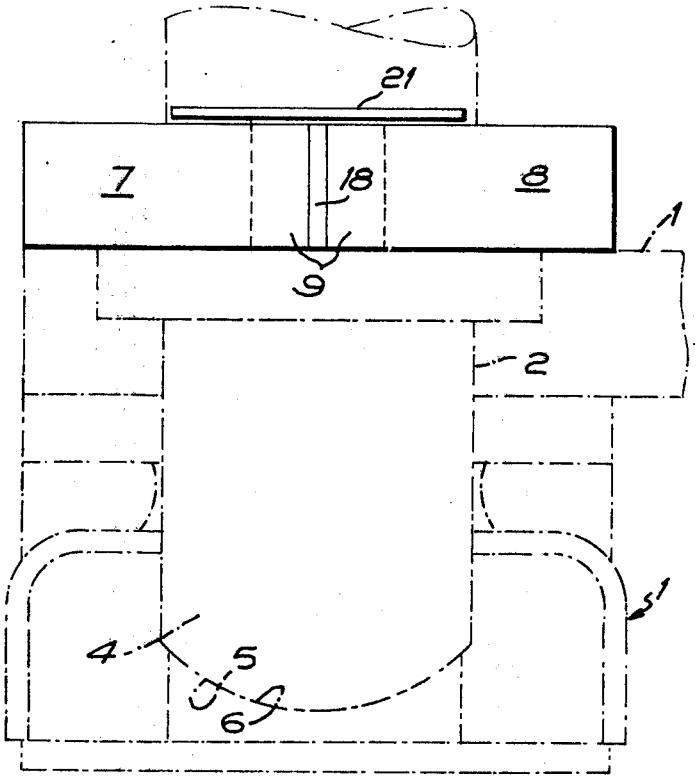
Figure 4:
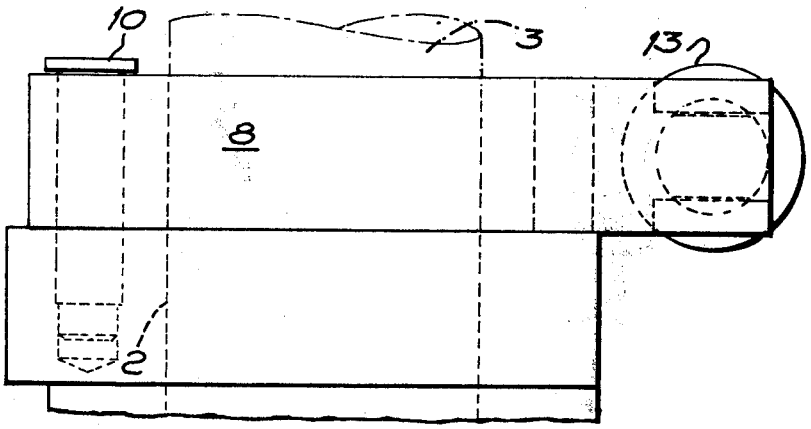
Figure 5:
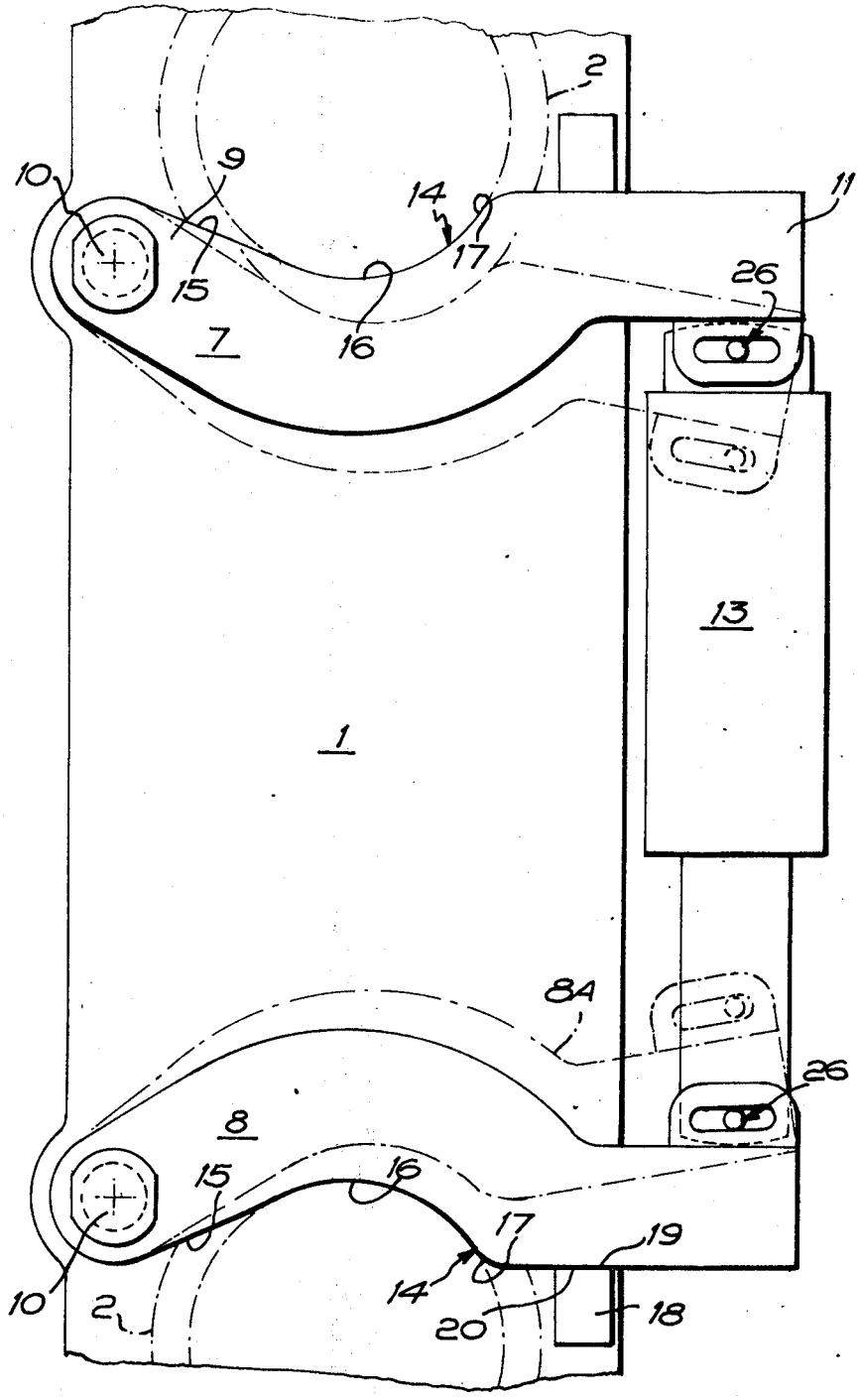
Figure 6:
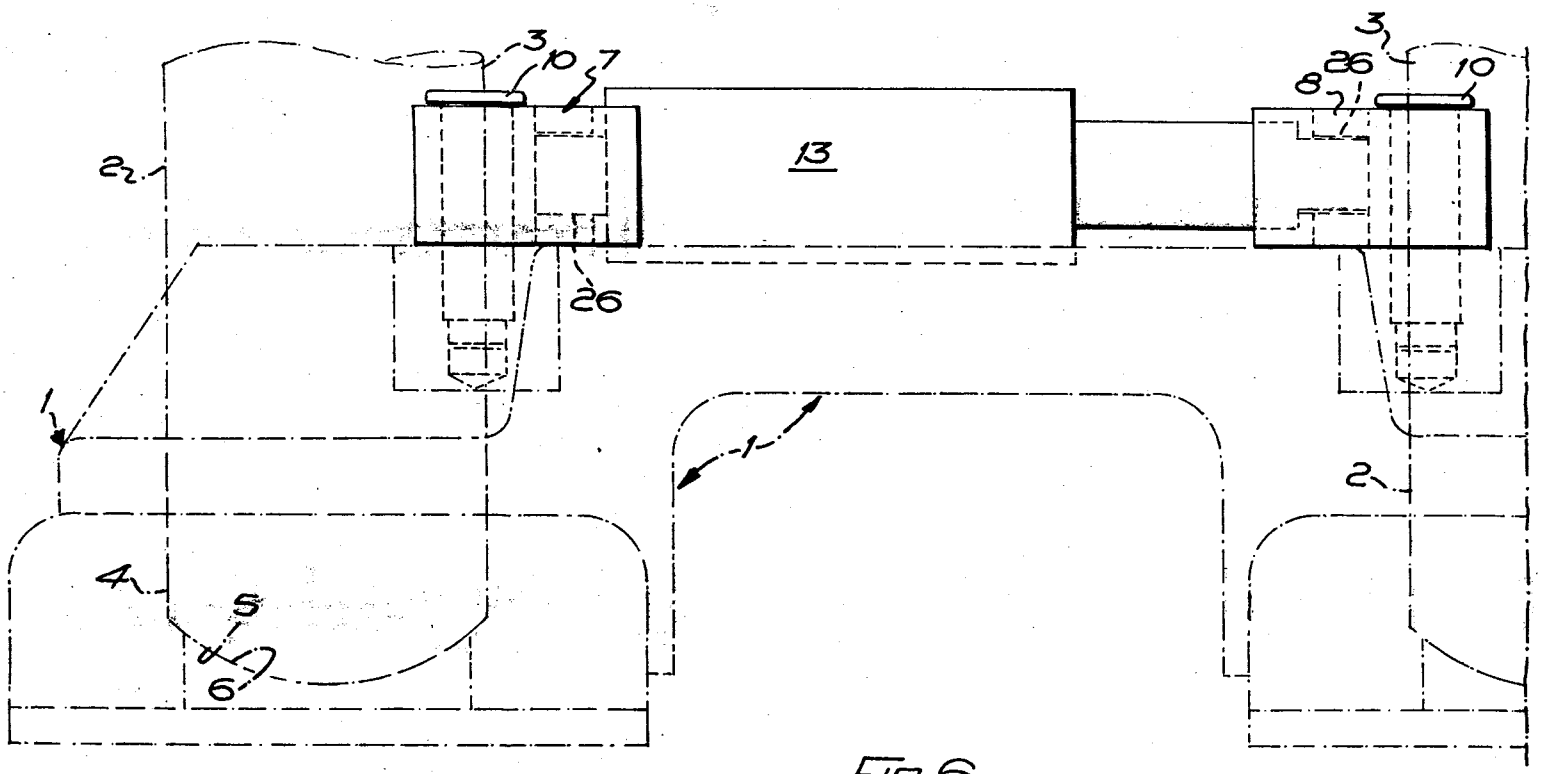

The invention will now be described in greater detail, by way of example, with reference to the accompanying drawings in which:

FIGS. 1 to 3 show an embodiment for restoring a single leg of a roof support with a pair of links; and FIGS. 4 to 6 show an embodiment for restoring a pair of legs of a roof support with a pair of links.

In both embodiments, like components are accorded like reference numerals.

In the first embodiment shown in FIGS. 1 to 3, there is illustrated a portion of a base member 1 of a mine roof support of the type incorporating a plurality of hydraulically extensible chock legs 2 having an external periphery 3. A lower end 4 of each chock leg 2 is articulated to the base member 1 by having a convex face 5, seating on a correspondingly concave face 6 of the base member 1, while upper ends (not shown) of the chock legs are articulated in a similar manner to a roof beam (not shown). As best seen in FIG. 2, a pair of links 7, 8 are each pivotally attached at one end 9 thereof to the base member 1 via a pivot pin 10, the other end 11 of each link 7, 8 being pivotally attached on a pivot pin 12 to a common hydraulic ram 13, which is permanently pressurised into its retracted condition. This has the effect of bringing bearing surfaces 14 of each link 7, 8 into engagement with the periphery 3 of the chock leg 2. Each bearing surface 14 comprises a rectilinear portion 15, a contiguous concave portion 16 and a contiguous rectilinear portion 17. Also mounted on the base member 1 is a stop 18, which is common to both links 7, 8, the stop having stop faces 19 abutted by a corresponding face 20 of each link 7, 8 when the chock leg 2 is in a non-displaced and predetermined position. The stop 18 carries at its upper end a retaining strap 21 having end portions 22 which bridge the links 7, 8 at the ends 11 of the links, to restrict any tendency in service for the ends 11 to be lifted from the base member 1.

In use, the roof support is arranged e.g. with the chock legs 2 set vertically (or if required inclined forwardly a few degrees, e.g., 3°) with the faces 19, 20 abutting under the influence of the ram 13. During any relative movement between the mine roof and the mine floor for example, the chock leg 2 is displaced from its initial predetermined position, about faces 5, 6 but such displacement has the effect of spreading one or both links 7, 8 outwardly in FIGS. 1 to 3 against the action of the ram 13. Thus if the chock legs 2 move in the direction of arrow 23, the link 7 would remain abutting its stop face 19, while the other link 8 would be displaced to the position 8A indicated in dotted line in FIG. 2. Upon release of the mine roof support from the roof by retracting the chock legs 2, the restoring forces of the ram 13, acting through the links 7, 8, restore the chock leg to its predetermined position before the roof support is reset to the roof by extension of the chock legs 2. If displacement were in the direction of arrows 24 or 25, i.e., along the diametral plane separating the links 7, 8 and their pivot pins 10 and 12, then both links 7, 8 would be displaced from stop faces 19.

In the second embodiment shown in FIGS. 4 to 6, two chock legs 2 are incorporated in a common base member 1, with peripheries 3 of adjacent sides of each chock legs 2 engaged by a bearing surface 14 of the links 7, 8 each having a pivot pin 10. In this embodiment, pin and slot connections 26 are provided between the ram 13 and the ends 11 of the links 7, 8, the ram 13 in this embodiment being permanently pressurized in to its extended condition and the maximum, inward displacement of the link 8 also being indicated in dotted line at 8A. Again, displacement of either or both chock legs 2, which may be connected to a common roof beam or to individual roof beams, in any direction about its or their longitudinal axes results, when the effect of the initial pressurisation of the ram 13 is eventually overcome, in displacement of one or more of the links 7, 8 inwardly, towards one another.

What we claim is:

1. A mine roof support comprising a roof beam, a base member, at least one hydraulically extensible chock leg connected at an upper end thereof in articulated manner to said roof beam, and connected at a lower end thereof in articulated manner to said base member, a pair of links each having bearing surfaces embracing a common chock leg by bearing on opposite sides thereof, one end of each said links being pivotally attached to said base member at a pivot point located to one side of a diametral plane passing through the longitudinal axis of said chock leg, the other end of each of said links being located to the other side of said diametral plane, a restoring ram acting upon said other ends of said links and adapted to displace at least one of said links about said pivot point, to restore said leg to its predetermined position upon release of said support from a mine roof, and also to resist tendency for said leg to become displaced from said predetermined position whilst said support is engaged with said mine roof, and stop means also mounted on said base member and engageable by at least one of said other ends of said links end to determine the maximum displacement of at least one of said other ends of said links by said restoring ram.

2. A mine roof support as claimed in claim 1, wherein said restoring ram is permanently pressurised.

3. A mine roof support as claimed in claim 1, wherein a common restoring ram is provided for said pair of links.

4. A mine roof support as claimed in claim 1, wherein said bearing surfaces of said links are both rectilinear and concave.

5. A mine roof support as claimed in claim 1, wherein said stop means is constituted by a common stop mounted on the base member and located adjacent the ram between the ends of the links connected thereto.

6. A mine roof support comprising a roof beam, a base member, at least one hydraulically extensible chock leg connected at an upper end thereof in articulated manner to said roof beam and connected at a lower end thereof in articulated manner to said base member, a pair of links each having bearing surfaces to bear on adjacent sides of a pair of spaced apart chock legs, one end of each of said links being pivotally attached to said base member at a pivot point located to one side of a diametral plane passing through the longitudinal axis of said individual chock legs the other end of each of said links being located to the other side of said diametral plane, a restoring ram acting upon said other ends of said links and adapted to displace at least one of said links about said pivot point, to restore said legs to their predetermined position upon release of said support from a mine roof, and also to resist tendency for said legs to become displaced from said predetermined position whilst said support is engaged with said mine roof, and stop means also mounted on said base member and engageable by at least one of said other ends of said links end to determine the maximum displacement of at least one of said other ends of said links by said restoring ram.

7. A mine roof support as claimed in claim 6, wherein said restoring cam is permanently pressurized.

8. A mine roof support as claimed in claim 6, wherein a common restoring ram is provided for said pair of links.

9. A mine roof support as claimed in claim 6, wherein said bearing surfaces of said links are both rectilinear and concave.

10. A mine roof support as claimed in claim 6, wherein a stop member is mounted adjacent each of said chock legs.

* * * * *